United States Patent [19]

Chen et al.

[11] Patent Number: 4,835,794

[45] Date of Patent: Jun. 6, 1989

[54] PRESET NECKTIE

[76] Inventors: Jiann-Jong Chen; Ching-Hwa Chen, both of 21, Alley, Lane 244, Sec. 5, Yen-ping North Road, Taipei, Taiwan

[21] Appl. No.: 163,592

[22] Filed: Mar. 3, 1988

[51] Int. Cl.[4] ..... A41D 25/02

[52] U.S. Cl. ..... 2/150; 24/418

[58] Field of Search ..... 2/144, 145, 150, 152, 2/155, 156; 24/387, 388, 415, 418, 421, 424, 436

[56] References Cited

U.S. PATENT DOCUMENTS 2,244,743 6/1941 Ulrich ..... 24/424

4,513,453 4/1985 Chen et al. ..... 2/150

FOREIGN PATENT DOCUMENTS 7412773 4/1975 Netherlands ..... 24/418

*Primary Examiner*—W. C. Reynolds

*Assistant Examiner*—D. Biefeld

*Attorney, Agent, or Firm*—Diller, Ramik & Wight

[57] ABSTRACT

A novel preset necktie comprises an outer tie, and inner tie, a zipper, a zipper slider of unique configuration, and a support body. The outer and the inner ties are both separate individual bodies with the upper portion of the inner tie being connected to form a loop and a zipper being disposed to the inner side of the lower portion thereof to form into the tie loop. With the inner tie having been threaded through the support body and the pull tab of the specially designed slider secured to the inner side of said slider, the size of the tie loop can be adjusted by pushing or pulling said support body. A pressing spring plate is provided on the inner side of the slider so as to keep the shape of the tie loop fixed. The upper portion of the outer tie is secured to the support body by means of a rivet and preset into a regular knot such that the user does not have to set the knot each time when wearing then necktie.

3 Claims, 2 Drawing Sheets

PRESET NECKTIE

BACKGROUND OF THE INVENTION

In zipper-preset neckties, the size of the tie loop is usually adjusted by means of a zipper. Since the pull tab of the zipper slider is secured to the inner side of a support body, it can not be turned over as in the case of using the zipper in a conventional manner such that the spine-shaped stopper pin provided on the inner side of the pull tab of a conventional zipper has to be removed (zippers of larger sizes are provided with stopping means on the suspended tabs) or the slider can not be slid. With these conventional types of preset neckties, however, there is the disadvantage that the tie loop occasionally tends to become loose by itself, thus making them less desirable.

SUMMARY OF THE INVENTION

The design of the preset necktie according to the present invention is directed to the above mentioned disadvantage. The zipper slider according to the present invention is designed not to have the spine-shaped stopper pin. Instead, on the inner side of the slider there is provided a pressing spring plate which gives a dragging force to prevent the slider from sliding away such that after the tie knot has been pushed up, the knot will not become loose under the influence of external force resulted from the swinging movements of the wearer's neck, thereby holding the knot at a fixed position.

BRIEF DESCRIPTION OF THE DRAWINGS

The present invention will now be described in greater detail with reference to the accompanying drawings in which.

DETAILED DESCRIPTION OF THE INVENTION

Figure 1:
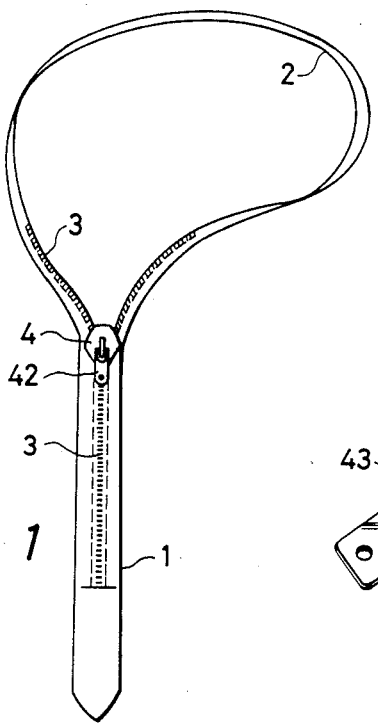
FIG. 1 shows the structure of the inner tie and the tie loop of the necktie according to the present invention.

Referring to the drawings, FIG. 1 shows the structure of the inner tie (1) and the tie loop (2), the upper portion of the inner tie (1) being connected into the shape of a ring to become the tie loop and the lower half of the tie loop (2) being provided with a zipper (3) such that the size of the tie loop (2) can be adjusted by pulling a zipper slider (4).

Figure 2:
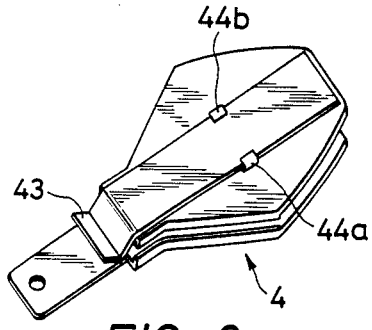
FIG. 2 is a perspective view showing the backside of the specially designed zipper slider.

FIG. 2 is a perspective view showing the backside of the specially designed zipper slider (4) of which the structure is characterized in that two small protruded tabs (44*a*, 44*b*) are provided on the backside thereof with a pressing spring plate (43) fitted therebetween to replace the stopper pin used with conventional zippers; the lower end of said spring plate (43) is bent inwardly with the tip thereof being adapted to press against the zipper teeth (6), allowing to increase the dragging force during sliding the zipper; and in that the dragging force is sufficient to prevent the zipper from over sliding without interfering with the up or down adjustment of the knot made by hands.

Figure 3:
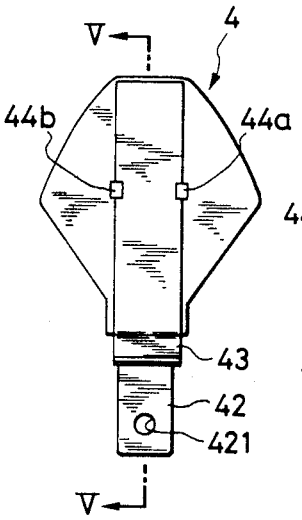
FIG. 3 is a rear elevation view of the zipper slider used with the necktie according to the present invention.

FIG. 3 is a rear elevation view of the zipper slider (4).

Figure 4:
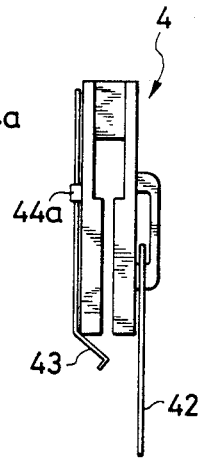
FIG. 4 is a right elevation view of the zipper slider.

FIG. 4 is a right elevation view of the zipper slider which is configured in exact lateral symmetry.

Figure 5:
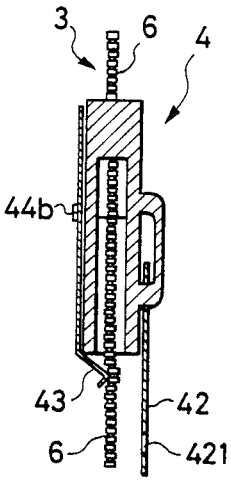
FIG. 5 is a cross section view of the zipper slider taken along line AA' of FIG. 3.

FIG. 5 is a cross section view of the zipper slider taken along line V-V of FIG. 3. It can be seen that the inwardly bent tip of the lower end of the pressing spring plate (43) is pointed back so that only refraining action is imposed on the zipper teeth (6) to merely result in a dragging force against the sliding of the zipper. With the plate thus configured, it will never hook at the zipper to influence the normal sliding movement or cause damage to the zipper teeth.

Figure 6:
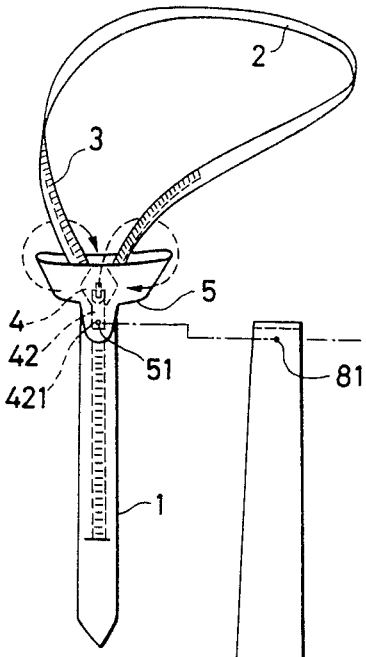
FIG. 6 shows the inner tie of the present invention being threaded into the support body.

FIG. 6 shows that the inner tie (1) is threaded into the support body (5) which has a hollow interior for receivig the inner tie (1) to slide up and down therein. The support body (5) which is approximately in the shape as shown in FIG. 6 enables the outer tie (8) to be wrapped therearound into a tie knot (9) of a conventional shape (see FIG. 8). In assembling, the inner tie (1) is firstly threaded into the support body (5), then the rivet hole (421) of FIGS. 3, 5 and 6 on the pull tab (42) of the slider (4), and the rivet hole (51) on the support body (5) (51 coincides with 421), and the rivet hole (81) on the upper end of the outer tie (8) are fixed together by means of a rivet at a suitable position as shown in FIG. 6.

Figure 7:
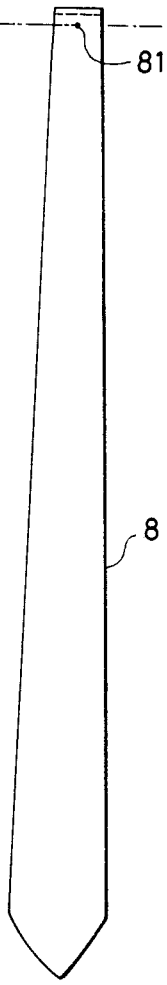
FIG. 7 is a plan view of the outer tie of the present invention.

FIG. 7 is a plan view of the outer tie (8) which is made of fabrics suitable for neckties and has a rivet hole (81) thereon.

Figure 8:
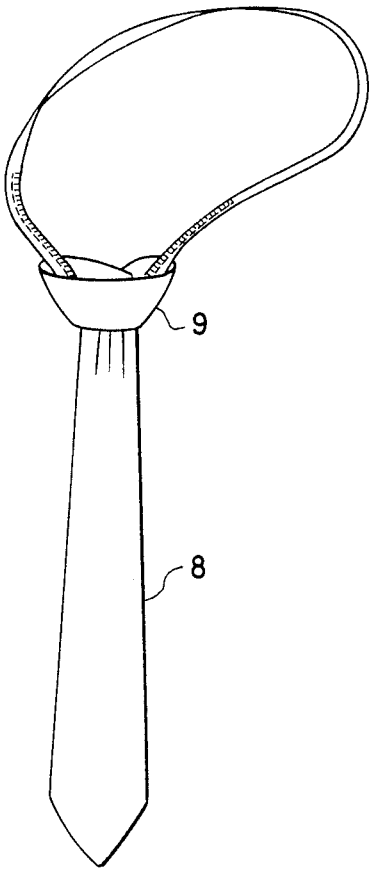
FIG. 8 shows the necktie as completed by having the outer tie securely connected to the support body to be tied into a knot in the direction as shown by the arrow in phantom line in FIG. 6.

FIG. 8 shows the necktie as completed by having the outer tie (8) securely connected to the support body (5) to be tied into a knot (9) in the direction as shown by the arrow in phantom line in FIG. 6. The necktie knot (9) is preset into shape and fixedly set by having been sewn with threads before being shipped from the factory so that it is not necessary to tie a knot, thereby avoiding the inconvenience of trying the knot every time when wearing the necktie.

From the foregoing, the structure and function of the necktie of the present invention should be thoroughly understood. The necktie of the present invention is very convenient to use and handle. In use, one needs only to stretch the tie loop (2) to have it enlarged and to put the enlarged tie loop on around the neck from above. Then the inner tie (1) is pulled to a suitable tightness with one hand while the tie knot (9) is being grasped with the other hand. After the inner tie is pulled to proper position the tie knot can thus be held in the fixed position for a long time because of the pressure provided by the spring plate of the zipper. Even for an active person, there is no danger of having the necktie become loose after a whole day's activities. When taking it off; one needs only to have the tie knot (9) hooked with a finger and to pull it down. Then the necktie can be removed from the head, thus making the necktie of the present invention very convenient to use.

We claim:

1. A preset necktie comprising an outer tie, an inner tie, a zipper, a zipper slider having a pull tab, and a support body, the outer tie being present into a knot, the inner tie being inserted through the support body, the pull tab of the zipper slider being secured to the support body, a pressing spring plate being provided on the backside of said zipper slider, and said spring plate being bent inwardly to press against the zipper to thereby prevent inadvertent sliding movement of said zipper.

2. The zipper slider as set forth in claim 1 including two small protruded tabs on the backside of said slider, and ends of said two small tabs being oppositely bent inwardly for securing the pressing spring plate to said zipper slider.

3. The pressing spring plate as set forth in claim 1 wherein said spring plate is made of a resilient metal plate fitted on the backside of said zipper slider, and an end of said metal plate being bent to a generally V-shaped configuration converging in a direction toward said zipper.

* * * * *